US008534174B2

(12) United States Patent
Kajita et al.

(10) Patent No.: US 8,534,174 B2
(45) Date of Patent: Sep. 17, 2013

(54) PYROTECHNIC ACTUATOR AND POWER CUTTING TOOL WITH SAFETY REACTION SYSTEM HAVING SUCH PYROTECHNIC ACTUATOR

(75) Inventors: Eishi Kajita, Thousand Oaks, CA (US); Vahan Avetisian, Thousand Oaks, CA (US); Abrar Tirmizi, Simi Valley, CA (US)

(73) Assignee: Power Tool Institute, Cleveland, OH (US)

( * ) Notice: Subject to any disclaimer, the term of this patent is extended or adjusted under 35 U.S.C. 154(b) by 537 days.

(21) Appl. No.: 12/890,985

(22) Filed: Sep. 27, 2010

(65) Prior Publication Data

US 2013/0152753 A1 Jun. 20, 2013

(51) Int. Cl.
*B26D 5/00* (2006.01)

(52) U.S. Cl.
USPC ..... 83/399; 89/1.4; 89/7; 89/27.3

(58) Field of Classification Search
USPC ..... 83/399; 89/7, 1.4, 27.3
See application file for complete search history.

(56) References Cited

U.S. PATENT DOCUMENTS

| | | | | |
|---|---|---|---|---|
| 2,202,125 | A * | 5/1940 | Temple, Jr. | 72/415 |
| 2,302,646 | A | 11/1942 | Temple | |
| 3,006,280 | A | 10/1961 | Rogers et al. | |
| 3,447,609 | A * | 6/1969 | Harvey | 169/20 |
| 3,861,880 | A * | 1/1975 | Thompson | 422/122 |
| 3,983,783 | A * | 10/1976 | Maxey | 89/1.57 |
| 4,198,896 | A * | 4/1980 | Lamic et al. | 89/1.818 |
| 4,523,508 | A * | 6/1985 | Mayer et al. | 89/7 |
| 4,934,242 | A * | 6/1990 | Bulman | 89/7 |
| 4,970,936 | A * | 11/1990 | Denker et al. | 89/1.14 |
| 5,303,631 | A | 4/1994 | Frehaut et al. | |
| 5,596,163 | A * | 1/1997 | Caflisch et al. | 102/202.2 |
| 5,806,884 | A * | 9/1998 | Johnson et al. | 280/736 |
| 6,227,563 | B1 * | 5/2001 | Talisman | 280/735 |

(Continued)

FOREIGN PATENT DOCUMENTS

| | | |
|---|---|---|
| DE | 19609771 A1 | 6/1988 |
| DE | 19504207 A1 | 10/1995 |

(Continued)

OTHER PUBLICATIONS

Written Opinion of the International Preliminary Examining Authority, PCT/US2011/038704, mailed Sep. 19, 2012.

(Continued)

*Primary Examiner* — Sean Michalski
(74) *Attorney, Agent, or Firm* — K&L Gates LLP

(57) ABSTRACT

A pyrotechnic actuator for a power cutting tool is disclosed. The pyrotechnic actuator comprises a housing defining a cavity therein, a piston positioned at least partially within the cavity, and an insert-molded unitary assembly positioned within the cavity. The unitary assembly comprises a piston engagement member and a base. A sealed void is defined intermediate the piston engagement member and the base. The unitary assembly comprises a breakable member extending intermediate the piston engagement member and the base and a pyrotechnic initiator positioned at least partially within the base. The pyrotechnic initiator, upon application of a current pulse thereto, is configured to generate a pressurized gas in the sealed void that exerts a force on the piston engagement member and breaks the breakable member thereby causing the piston engagement member and the piston to move relative to the base and the housing.

20 Claims, 11 Drawing Sheets

(56) References Cited

U.S. PATENT DOCUMENTS

| | | | | |
|---|---|---|---|---|
| 6,568,184 | B2 * | 5/2003 | Blackburn et al. | 60/636 |
| 6,672,194 | B2 | 1/2004 | Daoud | |
| 6,675,692 | B1 | 1/2004 | Goetz | |
| 6,796,245 | B2 | 9/2004 | Parker et al. | |
| 6,813,983 | B2 | 11/2004 | Gass et al. | |
| 6,834,730 | B2 | 12/2004 | Gass et al. | |
| 6,851,372 | B2 * | 2/2005 | Bender et al. | 102/530 |
| 6,857,345 | B2 | 2/2005 | Gass et al. | |
| 6,878,024 | B1 * | 4/2005 | Kohuth | 441/10 |
| 6,920,814 | B2 | 7/2005 | Gass et al. | |
| 6,922,153 | B2 | 7/2005 | Pierga et al. | |
| 6,945,149 | B2 | 9/2005 | Gass et al. | |
| 6,957,601 | B2 * | 10/2005 | Gass et al. | 83/62.1 |
| 6,994,004 | B2 * | 2/2006 | Gass et al. | 83/62.1 |
| 6,997,090 | B2 | 2/2006 | Gass et al. | |
| 7,024,975 | B2 | 4/2006 | Gass et al. | |
| 7,077,039 | B2 | 7/2006 | Gass et al. | |
| 7,098,800 | B2 | 8/2006 | Gass | |
| 7,100,483 | B2 | 9/2006 | Gass et al. | |
| 7,121,358 | B2 | 10/2006 | Gass et al. | |
| 7,197,969 | B2 | 4/2007 | Gass et al. | |
| 7,210,383 | B2 | 5/2007 | Gass et al | |
| 7,225,712 | B2 | 6/2007 | Gass et al. | |
| 7,228,772 | B2 | 6/2007 | Gass | |
| 7,231,856 | B2 | 6/2007 | Gass et al. | |
| 7,284,467 | B2 | 10/2007 | Gass et al. | |
| 7,290,474 | B2 | 11/2007 | Keller | |
| 7,296,504 | B2 * | 11/2007 | Borg et al. | 89/1.14 |
| 7,308,843 | B2 | 12/2007 | Gass et al. | |
| 7,350,444 | B2 | 4/2008 | Gass et al. | |
| 7,350,445 | B2 | 4/2008 | Gass et al. | |
| 7,357,056 | B2 | 4/2008 | Gass et al. | |
| 7,359,174 | B2 | 4/2008 | Gass | |
| 7,421,315 | B2 | 9/2008 | Gass et al. | |
| 7,421,932 | B1 | 9/2008 | Heinzmann et al. | |
| 7,444,918 | B2 | 11/2008 | Hirooka et al. | |
| 7,481,140 | B2 | 1/2009 | Gass et al. | |
| 7,484,448 | B2 * | 2/2009 | Schmid et al. | 89/1.14 |
| 7,628,101 | B1 | 12/2009 | Knapp et al. | |
| 7,721,544 | B2 | 5/2010 | Numoto et al. | |
| 7,735,405 | B2 * | 6/2010 | Parks | 89/1.14 |
| 7,739,934 | B2 | 6/2010 | Tetelbaum et al. | |
| 7,804,204 | B1 | 9/2010 | Shafer et al. | |
| 8,353,525 | B2 * | 1/2013 | Parks et al. | 280/728.2 |
| 2002/0017181 | A1 | 2/2002 | Gass et al. | |
| 2002/0020261 | A1 | 2/2002 | Gass et al. | |
| 2002/0020262 | A1 | 2/2002 | Gass et al. | |
| 2002/0020263 | A1 | 2/2002 | Gass et al. | |
| 2002/0020265 | A1 * | 2/2002 | Gass et al. | 83/62.1 |
| 2002/0069734 | A1 | 6/2002 | Gass et al. | |
| 2002/0170399 | A1 | 11/2002 | Gass et al. | |
| 2003/0005588 | A1 | 1/2003 | Gass et al. | |
| 2003/0015088 | A1 * | 1/2003 | Wursch et al. | 89/1.14 |
| 2003/0020336 | A1 | 1/2003 | Gass et al. | |
| 2003/0029307 | A1 * | 2/2003 | Daoud | 89/1.14 |
| 2003/0037651 | A1 | 2/2003 | Gass et al. | |
| 2003/0131703 | A1 | 7/2003 | Gass et al. | |
| 2003/0140749 | A1 | 7/2003 | Gass et al. | |
| 2004/0159198 | A1 | 8/2004 | Peot et al. | |
| 2004/0173430 | A1 | 9/2004 | Gass | |
| 2004/0226800 | A1 | 11/2004 | Pierga et al. | |
| 2005/0041359 | A1 | 2/2005 | Gass | |
| 2005/0066784 | A1 | 3/2005 | Gass | |
| 2005/0139057 | A1 | 6/2005 | Gass et al. | |
| 2005/0139058 | A1 | 6/2005 | Gass et al. | |
| 2005/0155473 | A1 | 7/2005 | Gass | |
| 2005/0166736 | A1 | 8/2005 | Gass et al. | |
| 2005/0268767 | A1 * | 12/2005 | Pierga et al. | 83/581 |
| 2006/0010745 | A1 * | 1/2006 | Fleischhauer et al. | 42/1.08 |
| 2006/0101960 | A1 * | 5/2006 | Smith et al. | 83/58 |
| 2006/0123960 | A1 | 6/2006 | Gass et al. | |
| 2006/0123964 | A1 | 6/2006 | Gass et al. | |
| 2006/0179983 | A1 | 8/2006 | Gass et al. | |
| 2006/0225551 | A1 | 10/2006 | Gass | |
| 2006/0247795 | A1 | 11/2006 | Gass et al. | |
| 2006/0254401 | A1 | 11/2006 | Gass et al. | |
| 2007/0028733 | A1 | 2/2007 | Gass | |
| 2007/0186737 | A1 | 8/2007 | Gass et al. | |
| 2007/0199470 | A1 * | 8/2007 | Huffman | 102/447 |
| 2007/0199622 | A1 | 8/2007 | Gass et al. | |
| 2007/0240786 | A1 | 10/2007 | Gass et al. | |
| 2008/0016998 | A1 | 1/2008 | Keller | |
| 2008/0029184 | A1 | 2/2008 | Gass | |
| 2008/0041204 | A1 | 2/2008 | Gass | |
| 2008/0092702 | A1 | 4/2008 | Gass et al. | |
| 2008/0238058 | A1 * | 10/2008 | Numoto et al. | 280/737 |
| 2010/0037739 | A1 | 2/2010 | Anderson et al. | |
| 2010/0170384 | A1 * | 7/2010 | Jarrett | 89/1.14 |
| 2010/0212481 | A1 * | 8/2010 | Koth | 89/7 |
| 2010/0244542 | A1 * | 9/2010 | Sealy et al. | 297/480 |
| 2010/0270351 | A1 * | 10/2010 | Lee | 227/9 |
| 2010/0288148 | A1 * | 11/2010 | Ritchie et al. | 102/202.7 |
| 2011/0146482 | A1 * | 6/2011 | Neff | 89/1.14 |

FOREIGN PATENT DOCUMENTS

| | | | |
|---|---|---|---|
| DE | 102 09 625 | A1 | 10/2003 |
| DE | 102 09 626 | A1 | 10/2003 |
| DE | 20 2006 007555 | U1 | 9/2007 |
| JP | 3122086 | A | 5/1991 |
| WO | WO 99/21253 | A1 | 4/1999 |
| WO | WO 2006/040714 | A1 | 4/2006 |
| WO | WO 2009/120538 | A1 | 10/2009 |
| WO | WO 2010/059786 | A1 | 5/2010 |

OTHER PUBLICATIONS

International Search Report and Written Opinion of the International Searching Authority for PCT/US2011/038704, Sep. 21, 2011 (17 pages).

* cited by examiner

PYROTECHNIC ACTUATOR AND POWER CUTTING TOOL WITH SAFETY REACTION SYSTEM HAVING SUCH PYROTECHNIC ACTUATOR

BACKGROUND

Many types of power tools have exposed blades, such as table saws and other power cutting tools. Contact between the blade and an object other than a workpiece can be dangerous. Safety systems to mitigate potentially dangerous conditions are continually being developed. Some such safety systems include a blade-drop mechanism that drops the blade below the working surface of the power tool when contact or near-contact with a foreign object is detected, for example. In some instances, such blade-drop mechanisms are actuated by a pyrotechnic actuator. Improved pyrotechnic actuators for these and other applications are needed.

SUMMARY

In one general aspect, the present disclosure is directed, in part, to a pyrotechnic actuator that can be manufactured with low cost manufacturing processes yet still perform very reliably. In one embodiment, the pyrotechnic actuator can be used in a power cutting tool, such as part of a blade-drop reaction system for a table saw. In such an embodiment, the pyrotechnic actuator can comprise a housing defining a cavity therein, a piston positioned at least partially within the cavity, and an insert-molded unitary assembly positioned within the cavity. The unitary assembly comprises a piston engagement member and a base. A sealed void is defined intermediate the piston engagement member and the base. The unitary assembly comprises a breakable member extending intermediate the piston engagement member and the base and a pyrotechnic initiator positioned at least partially within the base. The pyrotechnic initiator, upon application of a current pulse thereto, is configured to generate a pressurized gas in the sealed void that exerts a force on the piston engagement member and breaks the breakable member, thereby causing the piston engagement member and the piston to move relative to the base and the housing.

In another general aspect, the present disclosure is directed, in part, to a pyrotechnic actuator comprising a housing defining a cavity therein and an opening therethrough, and a unibody assembly positioned at least partially within the cavity. The unibody assembly comprises a piston assembly and a base. A portion of the piston assembly is configured to extend through the opening. A void is defined intermediate the piston assembly and the base. The unibody assembly comprises a frangible member extending intermediate the piston assembly and the base and a pyrotechnic initiator. The base is configured to receive at least a portion of the pyrotechnic initiator. The pyrotechnic initiator, upon application of a current pulse thereto, is configured to generate a pressurized gas in the void that exerts a force on the piston assembly and breaks the frangible member thereby causing the piston assembly to move relative to the base and the housing.

In another general aspect, the present disclosure is directed, in part, to a power cutting tool comprising a safety reaction system that comprises a pyrotechnic actuator. In such a power cutting tool, the pyrotechnic actuator actuates the safety reaction system that drops the blade out of a danger zone, such as below a tabletop or working surface for a table saw, for example, when a dangerous condition is detected by a detection system. In one embodiment, the power cutting tool comprises a working surface defining an opening therein, a blade configured to extend into the opening, a detection system for detecting a dangerous condition relative to the blade, and a safety reaction system in communication with the detection system. The safety reaction system is configured to cause the blade to move below the working surface when triggered by the detection system. The safety reaction system can comprise the pyrotechnic actuator described herein.

BRIEF DESCRIPTION OF THE FIGURES

Various non-limiting embodiments of the present disclosure are described herein in conjunction with the following figures, wherein.

DETAILED DESCRIPTION

Various non-limiting embodiments of the present disclosure will now be described to provide an overall understanding of the principles of the structure, function, manufacture, and use of a pyrotechnic actuator and a power cutting tool comprising the pyrotechnic actuator disclosed herein. One or more examples of these non-limiting embodiments are illustrated in the accompanying drawings. It will be appreciated that the pyrotechnic actuators and power cutting tools specifically described herein and illustrated in the accompanying drawings are non-limiting example embodiments and that the scope of the various non-limiting embodiments of the present disclosure are defined solely by the claims. The features illustrated or described in connection with one non-limiting embodiment can be combined with the features of other non-limiting embodiments. Such modifications and variations are intended to be included within the scope of the present disclosure.

Various embodiments of the present disclosure are directed to a pyrotechnic actuator. In one application, the pyrotechnic actuator can be utilized to actuate a safety system of a power cutting tool, such as a blade-drop mechanism or safety reaction system of a power cutting tool, such as a table saw, for example. Such safety systems take a danger-mitigating action in response to detection of a dangerous or potentially dangerous condition relative to the blade of the power cutting tool. Before describing the details of the pyrotechnic actuator of the present disclosure, details regarding such a power cutting tool that may employ the pyrotechnic actuator in a safety system are described.

Figure 1:
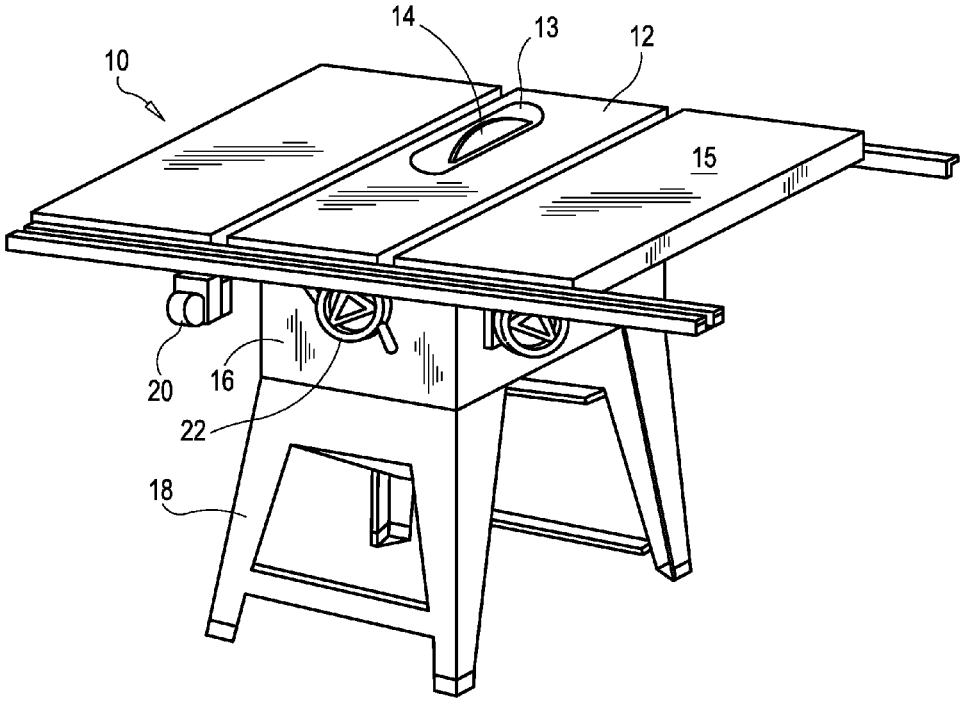
FIG. 1 is a perspective view of a power cutting tool comprising a detection system and a safety reaction system for a blade in accordance with one non-limiting embodiment.

In one embodiment, the pyrotechnic actuator can be employed, for example, in a safety system or safety reaction system of a table saw. FIG. 1 shows one type of example table saw 10. The table saw 10 comprises a table (or table top) 12 through which a circular blade 14 extends from beneath the table 12. The table 12 comprises a throat plate 13 that defines an elongated slot through which a portion of the circular blade 14 can extend. A workpiece (not shown), such as a piece of wood, can be placed on the cutting or working surface 15 of the table 12 and can be cut by the portion of the blade 14 extending above the cutting surface 15. The table 12 and the blade 14 are supported by a housing 16 and legs 18. The housing 16 can enclose the mechanisms that support, position, and drive the blade 14. The housing 16 can also comprise a processor-based system for detecting a dangerous condition relative to the blade 14, as described below, and/or a processor-based system for detecting a condition of the blade 14 (e.g., whether it is spinning). A motor to drive the blade 14 can be positioned in or outside of the housing 16. A switch 20 can be used to turn the saw on and off, causing the blade 14 to spin when turned on. A handle 22 can be used to manually adjust the position of the blade 14 relative to the table 12. For example, using the handle 22, an operator of the table saw 10 can adjust how far the blade 14 extends above the table 12 or how the blade 14 tilts relative to the cutting surface 15 of the table 12. A user places a workpiece on the table 12 and slides it into the blade 14 to cut the workpiece. Table saws take many different configurations, from large saws sized for industrial use to small saws that can be placed on a bench top or counter, and table saws come with various types of tables and housings. The safety and other mechanisms described herein can be employed in most any type of table saw, as will be apparent from the description below. The table saw 10 can also comprise a riving knife, a blade guard, and/or various other conventional components.

Figure 2:
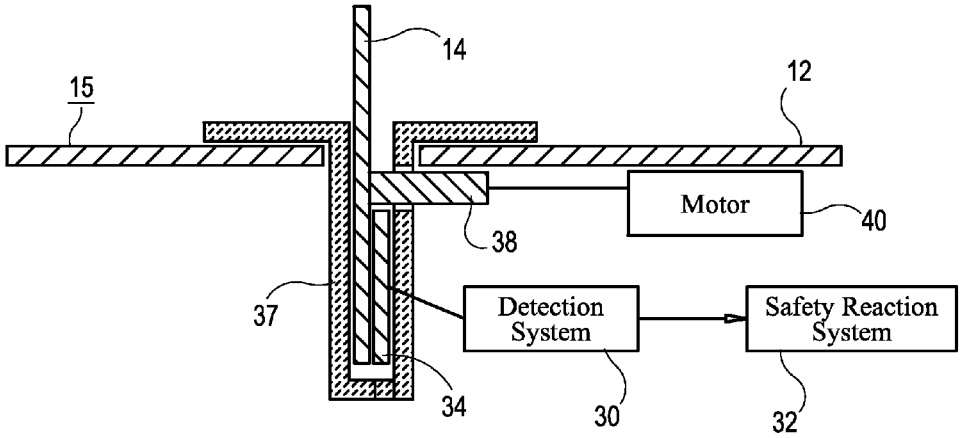
FIG. 2 is an illustration showing certain features of the power cutting tool of FIG. 1 in accordance with one non-limiting embodiment.

FIG. 2 is a diagram showing certain features of the table saw 10 according to various embodiments of the present disclosure. The blade 14 can be mounted to an arbor or a rotatable blade shaft 38. A motor 40 can drive the arbor 38 to spin the blade 14. The blade 14 can be directly driven by the motor 40 or indirectly driven through the use of one or more drive belts, chains, and/or gears. FIG. 2 illustrates that the table saw 10 can comprise a detection system 30 that can be used to detect a potentially dangerous condition with respect to the blade 14, such as when a foreign object (e.g., an object other than the workpiece) contacts or comes into close proximity to the blade 14, for example. The detection system 30 is in communication with a safety reaction system 32 (or danger-mitigating system), which takes a danger-mitigating action when triggered and/or actuated by the detection system 30 in response to detection of the dangerous condition.

In one embodiment, the detection system 30 can comprise a contact detection system that detects when a foreign object (e.g., different from the workpiece that is intended to be cut by the blade 14) contacts the blade 14. In other embodiments, the detection system 30 can comprise a proximity detection system that detects when the foreign object is dangerously proximate to the blade 14. Such a contact detection system can comprise a capacitive contact sensing system that detects contact of the foreign object with the blade 14 based on a change in an electrical signal on the blade 14 due to the change in capacitance when the foreign object contacts the blade 14. More details regarding such capacitive contact sensing detection systems 30 can be found in the following patent documents, which are hereby incorporated by reference herein in their entirety: (1) U.S. patent application Ser. No. 11/481,549, entitled "Capacitive Sensing System For Power Cutting Tool," filed on Jul. 6, 2006; (2) U.S. Pat. No. 7,739,934, entitled "Detection System For Power Tool," issued on Jun. 22, 2010; and (3) U.S. Pat. No. 7,640,835, entitled "Apparatus And Method For Detecting Dangerous Conditions In Power Equipment," issued on Jan. 5, 2010. Other suitable detection systems, including non-contact detection systems, are described in the following patent documents, which are hereby incorporated by reference herein in their entirety: (1) published PCT WO/2010/059786, entitled "Safety Mechanisms for Power Tools," filed on Nov. 19, 2009; (2) U.S. Pat. No. 7,421,932, entitled "Power Cutting Tool Comprising A Radar Sensing System," issued on Sep. 9, 2008; and (3) U.S. Patent Appl. Publ. No. 2010/0037739, entitled "Power Cutting Tool With Overhead Sensing System," published on Feb. 18, 2010.

In various embodiments, still referring to FIGS. 1 and 2, the safety reaction system 32 can serve to mitigate the potentially dangerous condition detected by the detection system 30. In one embodiment, the safety reaction system 32 can drop the blade 14 below the tabletop 12 when triggered or actuated. Examples of such safety reaction systems are described in U.S. Pat. No. 7,628,101, entitled "Pyrotechnic Drop Mechanism For Power Tools," issued on Dec. 8, 2009, and U.S. Pat. No. 6,922,153, entitled "Safety Detection And Protection System For Power Tools," issued on Jul. 26, 2005, both of which are hereby incorporated by reference herein in their entirety.

Figure 3:
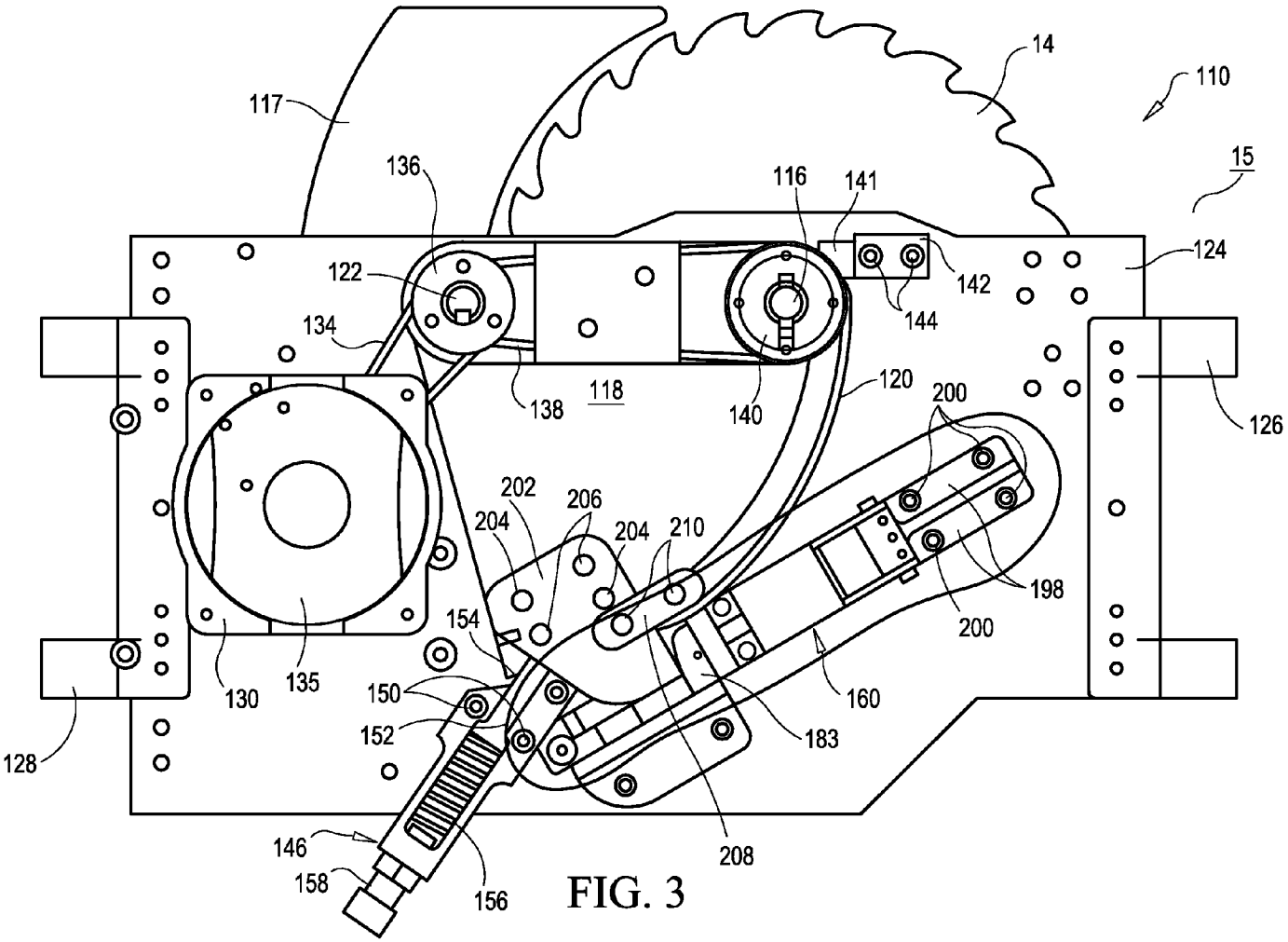
FIG. 3 is a side view of a safety reaction system of a power cutting tool, illustrating a blade in a normal operating position in accordance with one non-limiting embodiment.
Figure 4:
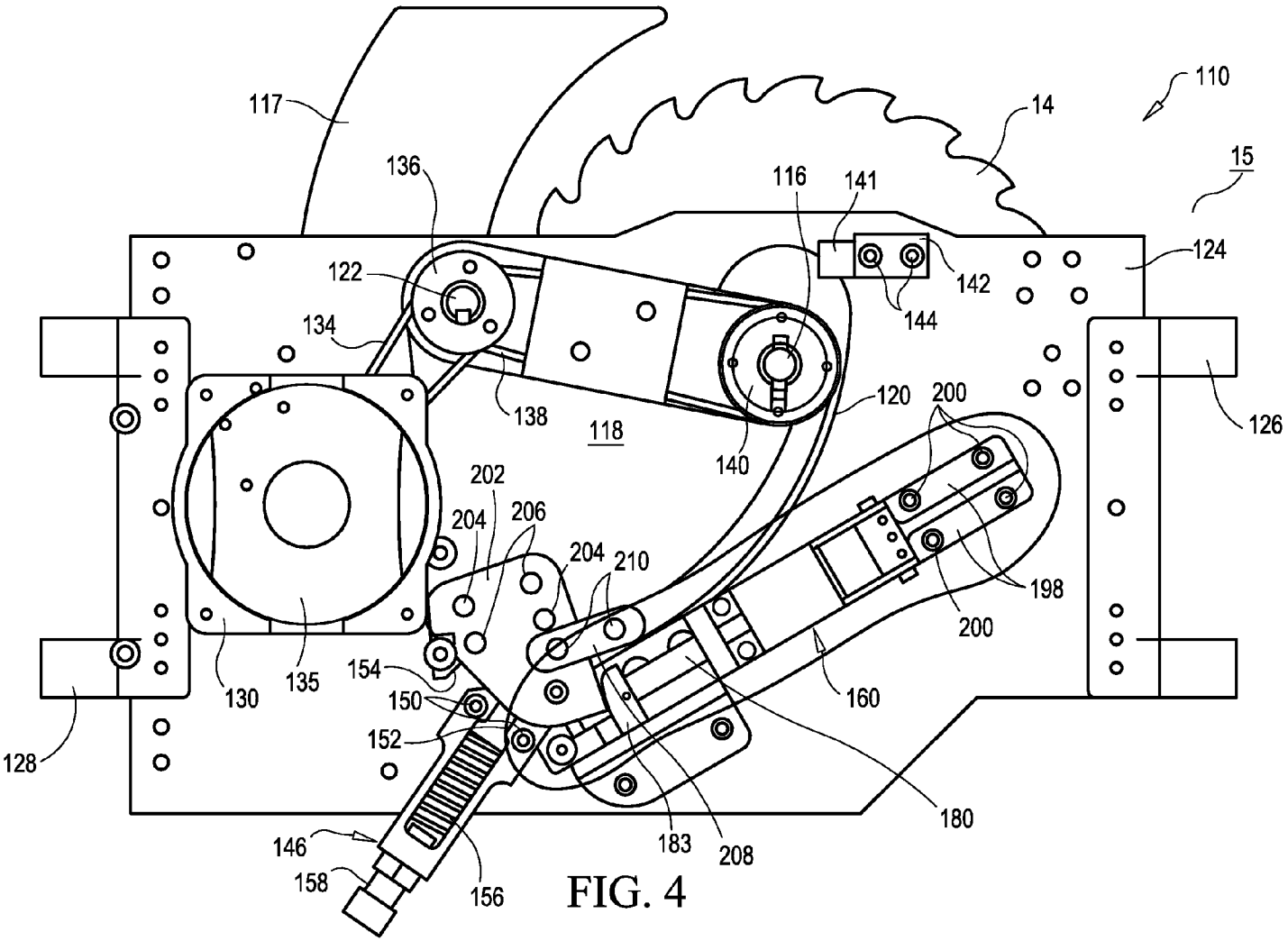
FIG. 4 is a side view of the safety reaction system of FIG. 3, illustrating the blade in a partially retracted position in accordance with one non-limiting embodiment.
Figure 5:
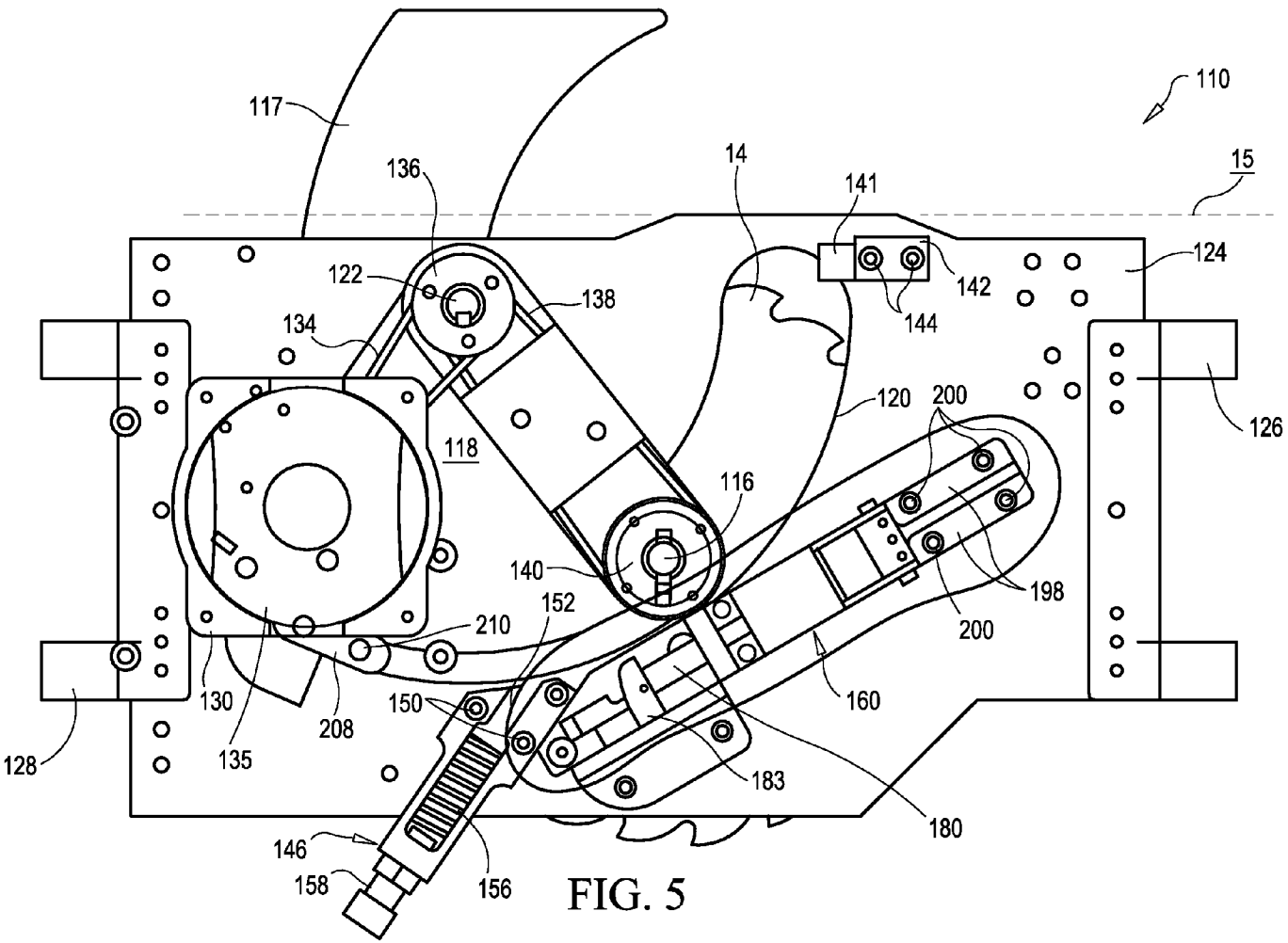
FIG. 5 is a side view of the safety reaction system of FIG. 3, illustrating the blade in a fully retracted position in accordance with one non-limiting embodiment.

In one embodiment, referring to FIGS. 3-5, a side view of the safety reaction system 32 for use with a power cutting tool is illustrated. The safety reaction system 32 is indicated generally at 110. In FIG. 3, the blade 14 is in a normal operating position near a riving knife 117. In FIG. 4, the blade 14 is shown to be in a partially retracted position as would occur during operation of the safety reaction system 32, and in FIG. 5, the blade 14 is in a fully retracted position below the working surface 15 of the table top 12, which is approximately at the elevation shown in FIGS. 3-5. The blade 14 rotates on a shaft 116 that is journaled in a generally triangularly shaped arm 118 that has a curved lower surface 120. The arm 118 rotates around another shaft 122 that is attached to a large plate 124 that is mounted to the table saw 10 by mounting brackets 126 and 128 located on opposite ends of the plate 124. The plate 124 carries a motor base 130 that is mounted above the elevation of the plate 124 and carries a motor 135 for driving the blade 14.

The output shaft of the motor 135 is not shown, but it can carry a pulley, which drives a belt 134 and a pulley 136 according to various embodiments. The pulley 136 is connected to another pulley or has an extension for driving a belt 138 that in turn drives a pulley 140 that is operatively connected by the shaft 116 to an arbor (not illustrated), but which drives the blade 14. Since the arm 118 is pivotable about the shaft 122, it should be understood that the motor 135 is configured to drive the belts 134 and 138 via the motor pulley and the pulley 136 regardless of the vertical position of the blade 14. Stated another way, the distance between the pulleys 136 and 140 can remain constant, as does the distance between pulley 136 and the motor draft shaft, regardless of the vertical position of the blade 14.

In one embodiment, when the blade 14 is in the normal operating position as illustrated in FIG. 3, the top right surface of the arm 118 abuts against a stop member 141 that is mounted to the plate 124 by a mounting bracket 142 using bolts 144. The arm 118 is held in the upper position as shown in FIG. 3 by a detent assembly, indicated generally at 146, that comprises a main bracket that is bolted to the plate 124 by bolts 150, wherein a detent rod 152 engages a V-shaped recess 154. The detent rod 152 is biased into engagement with the recess 154 by a spring 156 that is seated on a bolt 158 and which is adjustable to vary the biasing force that is applied to the detent rod 152. The detent assembly 146 is therefore designed and configured to maintain the arm 118 in its normal operating position unless it is rotated downwardly with sufficient force to depress the detent rod 152 away from the V-shaped recess 154 and release the arm 118 for rotation.

The force that is necessary to overcome the detent assembly 146 is provided by a firing mechanism or a pyrotechnic actuator that is indicated generally at 160. Various embodiments of pyrotechnic actuators will be discussed in greater detail below. FIGS. 4 and 5 illustrate an example embodiment of a pyrotechnic actuator 160 being actuated. As the piston 180 of the pyrotechnic actuator 160 is deployed from a housing of the pyrotechnic actuator 160, a hammer 183 is driven in the leftward direction causing the arm 118 to rotate in the clockwise direction around the shaft 122 and drop and/or fire the blade 14 into the retracted position below the working surface 15. Support members 198 are bolted to the plate 124 by bolts 200.

In one embodiment, an anvil 202 is connected to the arm 118 by a pair of pins 204, a pair of bolts 206, as well as by a strap 208 that is bolted on opposite ends to the anvil 202 and the arm 118. It should be apparent that the front surface of the hammer 183 is in contact with the adjoining surface of the anvil 202 so that when the pyrotechnic actuator 160 is activated, the piston 180 will cause the hammer 183 to move the anvil 202 and the arm 118 in a clockwise direction so as to retract the blade 14 below the table 12 or working surface 15 thereof before an operator is injured by the blade 14.

When the pyrotechnic actuator 160 receives a current pulse initiated from the detection system 30, the piston 180 is forced outwardly to move the anvil 202 as it does so. This pushing force overrides the detent assembly 146 and the arm 118 rotates and/or is fired in a clockwise direction. Since the arm 118 and the hammer 183 are not physically connected, (i.e., they only touch) the arm 118 is free to continue rotating even though the piston 180 stops moving after being fully deployed. The arm 118 continues to rotate until it contacts a mechanical stop that is not shown, at which time its movement ends.

Various pyrotechnic actuators that are currently available may not be considered for use in many high volume applications due to the high costs of designing and manufacturing such actuators. The pyrotechnic actuators of the present disclosure, however, incorporate unique features which allow low cost design and manufacturing methods to be utilized without compromising safety, quality, and/or design integrity. Some features of the pyrotechnic actuators of the present disclosure are that they can be constructed to be tamper-proof and can be viewed to determine whether they have been actuated.

Figure 6:
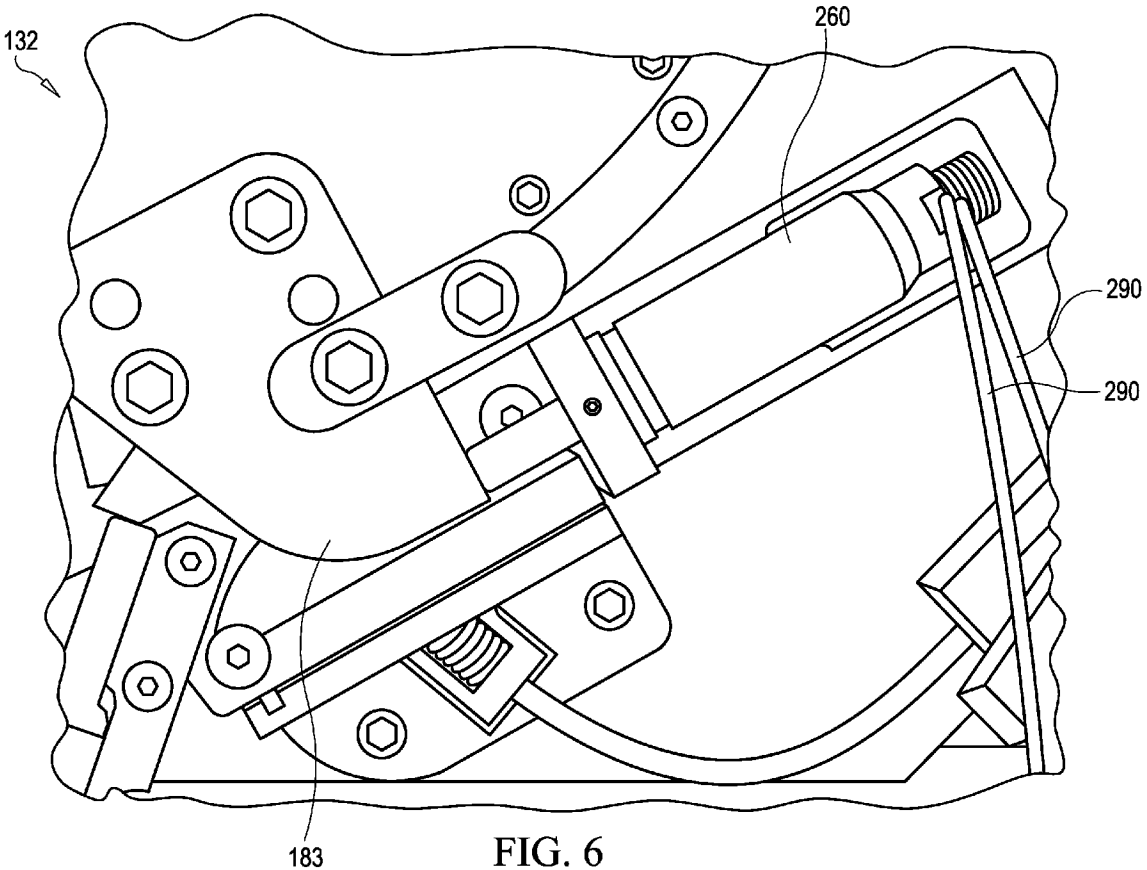
FIG. 6 is a perspective view of a pyrotechnic actuator mounted on a portion of a safety reaction system of a power cutting tool in accordance with one non-limiting embodiment.
Figure 7:
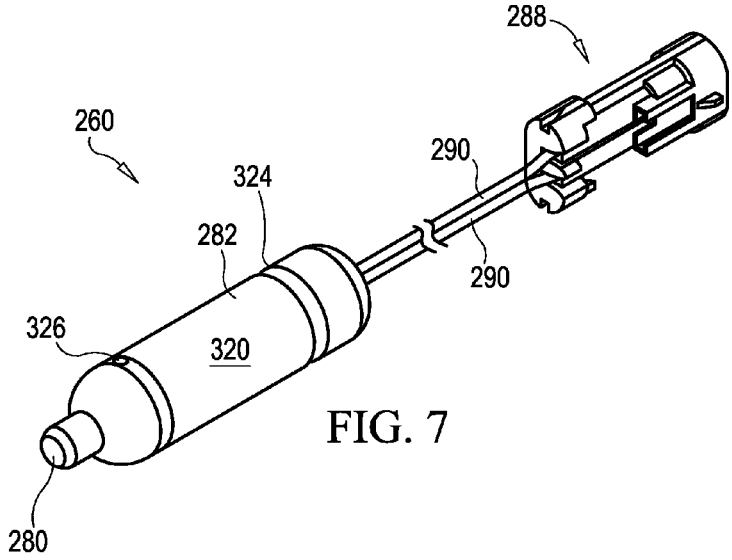
FIG. 7 is a perspective view of a pyrotechnic actuator, conductors, and a connector interface in accordance with one non-limiting embodiment.

In one embodiment, referring to FIG. 6, a pyrotechnic actuator 260 of the present disclosure is illustrated positioned within a safety reaction system 132 on a table saw. The safety reaction system 132 can comprise similar components as that described above in relation to FIGS. 3-5 and the safety reaction system 32.

In one embodiment, referring to FIGS. 7-14, the pyrotechnic actuators of the present disclosure will now be described in greater detail. In various embodiments, the pyrotechnic actuator 260 can comprise a housing 282 having a cavity 284 defined therein. The housing 282 can also define an opening 286 defined therethrough on an end thereof or at another suitable location. In various embodiments, the housing 282 can be comprised of a metallic material, such as aluminum, for example. In one embodiment, a portion of the generally cylindrical piston 280 can extend from the housing 282 even when the piston 280 is in the non-deployed position (see e.g., FIGS. 7-9). In other various embodiments, the piston 280 can be positioned inside the housing 282 when the piston 280 is in the non-deployed position. The piston 280 can be attached to or formed with a unitary assembly, as discussed below.

Figure 8:
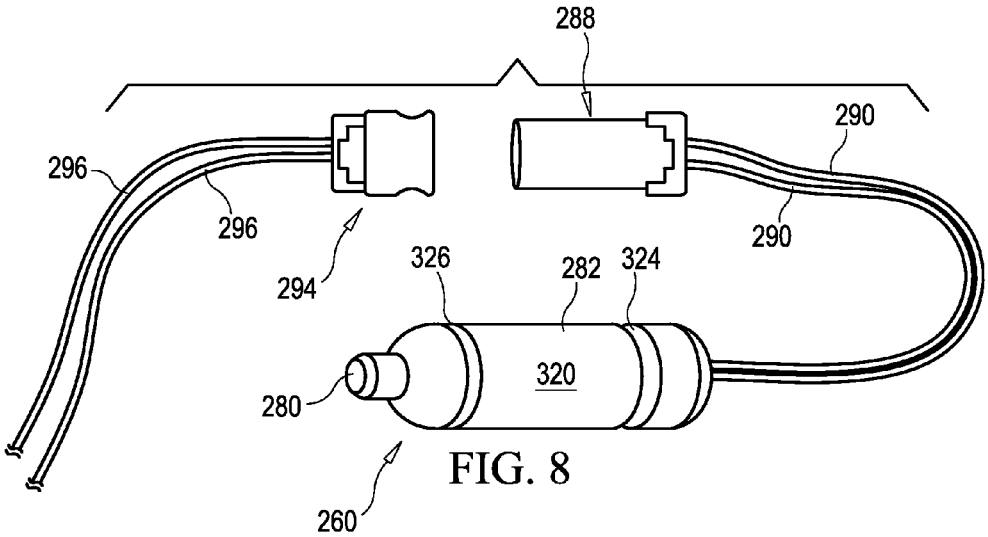
FIG. 8 is a perspective view illustrating how a pyrotechnic actuator assembly connects to an electrical system of a safety reaction system and/or detection system of a power cutting tool in accordance with one non-limiting embodiment.
Figure 12:
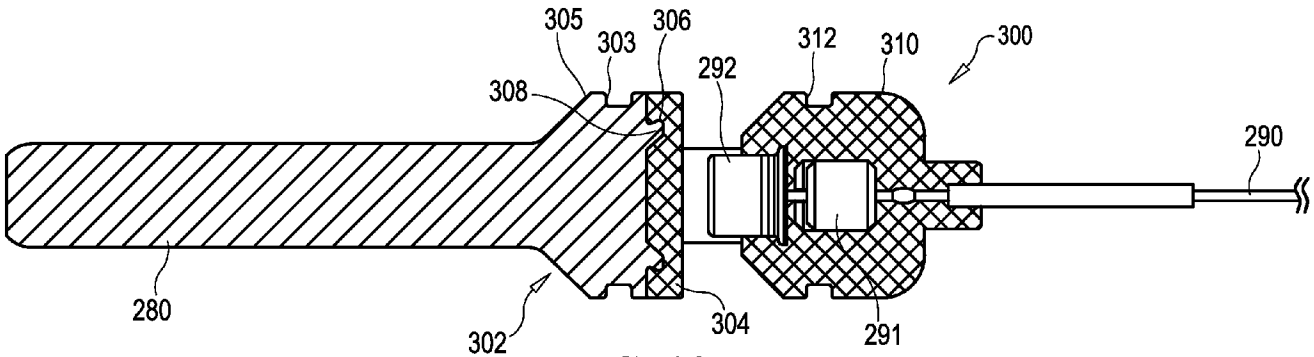
FIG. 12 is a cross-sectional view taken along line 12-12 of FIG. 11 in accordance with one non-limiting embodiment.
Figure 13:
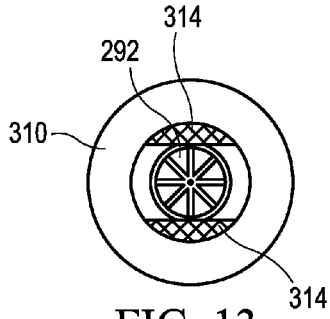
FIG. 13 is a cross-sectional view taken along line 13-13 of FIG. 11 in accordance with one non-limiting embodiment.
Figure 14:
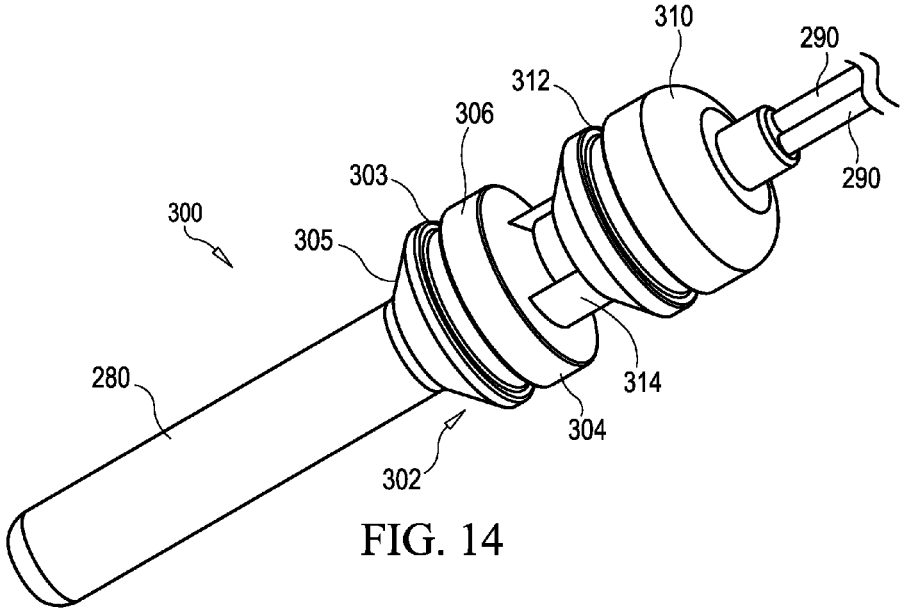
FIG. 14 is a perspective view of the unibody assembly of FIG. 11 in accordance with one non-limiting embodiment.

In one embodiment, referring to FIGS. 8 and 12, the pyrotechnic actuator 260 can be in communication with a connector interface 288 through conductors 290. The conductors 290 are configured to transmit a current pulse from the connector interface 288 to an initiator 292, such as a pyrotechnic initiator, for example, within the housing 282 to cause the piston 280 to move from the non-deployed position into the deployed position. The current pulse can be initiated from the detection system 30 when a dangerous condition is detected. In various embodiments, the initiator 292 can be a conventional initiator or a pyrotechnic initiator. In one embodiment, the connector interface 288 can be connected to a mating connector 294 (see, FIG. 8) attached to conductors 296 in electrical communication with, for example, an amplifier (not shown) that amplifies the signal from the detection system 30 of the power cutting tool. In one embodiment, the connector interface 288 can have male pins while the mating connector 294 can be configured to receive such male pins or, in other embodiments, the mating connector 294 can have male pins while the connector interface 288 can be configured to receive such male pins. As a result, when the detection system 30 detects a dangerous condition, a current pulse can be delivered through the conductors 296, through the mating connector 294, through the connector interface 288, through the conductors 290, through a ferrite filter 291, and to the initiator 292 within the housing 282.

In one embodiment, referring to FIGS. 9-14, a unitary assembly or an insert-molded unitary assembly 300 can be positioned within the housing 282. In various embodiments, the unitary assembly 300 can comprise a piston assembly 302 comprising a piston engagement member 304 and the piston 280. In various embodiments, the piston assembly 302 can be formed of a single component or material comprising the piston 280 and the piston engagement member 304 or, in other embodiments, can be formed of more than one component or material comprising the piston 280 and the piston engagement member 304. In one embodiment, the piston engagement member 304 can be formed separate from the piston 280, but attached to the piston 280. In an embodiment where the piston engagement member 304 is attached to the piston 280, the piston engagement member 304 can comprise an annular groove 306 in a face thereof and the piston 280 can comprise an annular projection 308 extending from an end thereof (see, FIG. 12). The annular projection 308 is configured to be engaged with the annular groove 306 to engage the piston 280 with the piston engagement member 304 in an interlocking fashion. In one embodiment, an adhesive can be used to aid the engagement of the annular projection 308 with the annular groove 306. In other various embodiments, the piston 280 can be engaged with or connected to the piston engagement member 304 in other suitable ways known to those of skill in the art. In one embodiment, the piston assembly 302, the piston 280, and/or the piston engagement member 304 can comprise an annular groove 303 configured to receive a sealing member, such as an o-ring, for example. The piston assembly 302 and/or the piston 280 can comprise a ramped portion 305. In one embodiment, the piston 280 can be a cold-drawn piston and the piston engagement member 304 can be formed with the unitary assembly 300. In various embodiments, the piston 280 can be comprised of a metallic material, while the unitary assembly 300 can be comprised of a non-metallic material, such as nylon 70G, for example.

In one embodiment, referring to FIGS. 9-14, the unitary assembly 300 can comprise a base 310 on an opposite end as the piston assembly 302. The initiator, or micro-gas generator, 292 is positioned on the base 310 or is positioned at least partially or fully within a cavity formed in the base 310. The conductors 290 can extend through the base 310 to the initiator 292 and can be configured to direct a current pulse from, for example, an amplifier (not shown) that amplifies a signal from the detection system 30 to the initiator 292. The base 310 can comprise an annular groove 312 defined therein which is configured to receive a sealing member, such as an o-ring, for example. In one embodiment, the base 310 can house a ferrite filter 291 in communication with the conductors 290 and the initiator 292.

In one embodiment, still referring to FIGS. 9-14, the unitary assembly 300 can comprise at least one frangible, separatable, and/or breakable member 314 (hereafter "frangible member"). The at least one frangible member 314 can extend from the base 310 to the piston engagement member 304 or to the piston assembly 302, if the piston 280 is formed with the piston engagement member 304. In various embodiments, the frangible member 314 can comprise a plurality of frangible struts, such as two to four, for example, extending between the base 310 and the piston engagement member 304 or the piston assembly 302. The plurality of frangible struts can be arranged in any suitable configuration, such as the configuration illustrated in FIG. 13, for example. In various embodiments, the frangible members 314 can comprise a portion that is frangible, separatable, and/or breakable, while the remainder of the frangible members 314 are not frangible, separatable, and/or breakable. In other various embodiments, the frangible members 314 can comprise score lines, reduced material portions (e.g., smaller perimeter, diameter, and/or thickness), weakened portions, and/or perforated portions. In such an embodiment, the frangible members 314 can be configured to break along or about such score lines, reduced material portions, weakened portions, and/or perforated portions after ignition of the initiator 292. In still other various embodiments, the frangible members 314 can break at or proximate to their attachment to the base 310 or the piston assembly 302 or the piston engagement member 304. In one embodiment, the frangible members 314 can be comprised of a non-metallic material, such as Nylon 70G, for example. In various embodiments, the frangible members 314 can be formed of the same materials as the piston assembly 302, the piston engagement member 304, the piston 280, and/or the base 310. The frangible members 314 can have any suitable cross-sectional shape, such as round, ovate, rectangular, square, and/or triangular, for example, and can have any suitable length between the base 310 and the piston assembly 302 based on the size and purpose of a particular pyrotechnic actuator. The frangible members 314 can be configured and constructed such that they will only break upon actuation of the pyrotechnic initiator 292.

In one embodiment, a bushing 316, such as a step bushing, for example, can be positioned within the cavity 284 of the housing 282. The bushing 316 can be positioned on an end of the housing 282 most distal from the base 310. The bushing 316 can define a bore 318 therethrough configured to receive a portion of the piston 280. The bore 318 can be aligned with the opening 286 in the housing 282, such that, upon actuation of the pyrotechnic actuator 260, the piston 280 can extend longitudinally through the bore 318 and the opening 286. In one embodiment, referring to FIGS. 7 and 8, when the piston 280 of the pyrotechnic actuator 260 is in the non-deployed position, the piston 280 can at least partially extend through the bore 318 and the opening 286. In one embodiment, the piston 280 can extend from the housing 282 a first distance prior to actuation of the pyrotechnic initiator 292 (see, FIG. 9) and can extend from the housing 282 a second distance after actuation of the pyrotechnic initiator 292 (see, FIG. 10). In one embodiment, the piston assembly 302 and/or the piston 280 can be in a first position relative to the base 310 and/or the housing 282 prior to ignition of the pyrotechnic initiator 292 and can be in a second position relative to the base 310 and/or the housing 282 after ignition of the pyrotechnic initiator 292.

In one embodiment, the bushing 316 can be comprised of a rubber material and can be used to decelerate the piston 280 and/or the piston assembly 302 as the piston 280 and/or the piston assembly 302 is moved or fired into the deployed position after actuation of the pyrotechnic initiator 292. In various embodiments, the piston 280 and/or the piston assembly 302 can be decelerated when the ramped portion 305 engages a portion of the bushing 316 distal from the opening 286 in the housing 282. In one embodiment, the bushing 316 can serve as an environmental seal to prevent, or at least inhibit, foreign materials from entering the cavity 284 of the housing 282. The bushing 316 can also be used to prevent, or at least inhibit, flames from escaping out of the cavity 282 during actuation of the initiator 292. The bushing 316 can have different shapes and sizes based on a particular application.

In one embodiment, referring to FIGS. 7-10, the housing 282 can comprise an exterior wall 320 and an interior wall 322. The exterior wall 320 can comprise at least one annular groove therein. In one embodiment, the exterior wall 320 can comprise a first annular groove 324 and a second annular groove 326. The first and second annular grooves 324 and 326 can be formed by crimping the housing 282, for example, or through other suitable methods. In one embodiment, through formation of the first and second annular grooves 324 and 326, annular lips or projections can be formed in the interior wall 322. The annular lips or projections can also be formed using other methods. A first lip or projection 328 can be formed by the first annular groove 324 and a second lip or projection 330 can be formed by the second annular groove 326. The first and second lips or projections 328 and 330 can each extend inwardly into the cavity 284 toward the unitary assembly 300. The first lip or projection 328 can engage the base 310 prior to and after actuation of the pyrotechnic initiator 292. In essence, the first lip or projection 328 can maintain the base 310 in position during and after actuation of the pyrotechnic initiator 292 by contacting the base 310 and preventing, or at least inhibiting, the base 310 from moving toward the opening 286 in the housing 282. The second lip or projection 330 can engage the piston 280 and/or the piston assembly 302 after actuation of the pyrotechnic initiator 292. Stated another way, the second lip or projection 330 can engage the piston 280 and/or the piston assembly 302 to help decelerate and/or stop the piston 280 and/or the piston assembly 302 after actuation of the pyrotechnic initiator 292. In one embodiment, the second lip or projection 330 can be positioned proximate to the bushing 316. In various embodiments, the ramped portion 305 of the piston 280 and/or the piston assembly 302 can engage the second lip or projection 330 to decelerate and/or stop the piston 280 and/or the piston assembly 302 after actuation of the pyrotechnic initiator 292. In one embodiment, the lips or projections 328 and 330 may not be provided. In such an embodiment, the base 310 can be glued or otherwise fixed to the housing 282 as the same location as illustrated and the bushing 316 can act to decelerate the piston 280 and/or the piston assembly 302.

In one embodiment, although not illustrated, the first and second annular grooves 324 and 326 may not be provided on the exterior wall 320 of the housing 282. Lips or projections, however, may still be formed on the interior wall 322. In one embodiment, the lips or projections formed on the interior wall 322 can be discontinuous about the perimeter of the interior wall 322. For example, the lips or projections may only extend about a portion of the perimeter of the interior wall 322, such as about 50%. In other embodiments, the first lip or projection 328 and/or the second lip or projection 330 can be formed of a plurality of discontinuous portions. The lips or projections can have any suitable size and shape. In one embodiment, the lips or projections can have a wedge or triangular shaped cross-section such that they can better maintain the base 310 in the suitable position and decelerate the piston 280 and/or the piston assembly 302.

Figure 9:
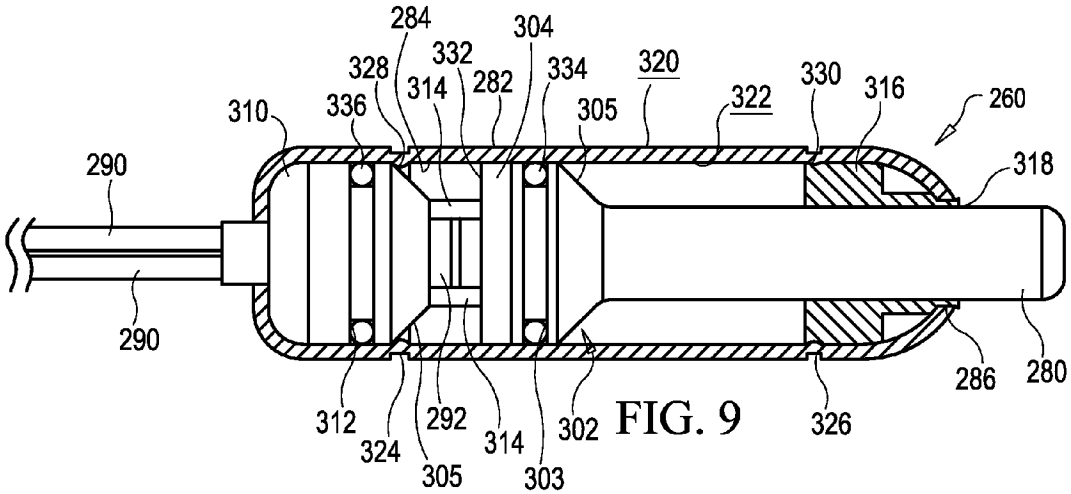
FIG. 9 is a side view of the pyrotechnic actuator of FIG. 7 with part of the housing cut away and the pyrotechnic actuator in the non-deployed position in accordance with one non-limiting embodiment.

In one embodiment, referring to FIG. 9, a void 332 or a sealed void can be defined intermediate the base 310 and the piston assembly 302 and/or the base 310 and the piston engagement member 304. The initiator 292 can be in fluid communication with the void 332 to allow gas generated by the initiator 292, upon actuation, to fill the void 332. Eventually the gas will fill the void 332 and pressurize the void 332 to such an extent as to cause the frangible member 314 to break, thereby allowing the piston assembly 302 to move relative to the base 310 and/or move away from the base 310. In one embodiment, an outer perimeter of the base 310, an outer perimeter of the piston assembly 302, an outer perimeter of the piston engagement member 304, and/or an outer perimeter of the piston 280 can sealably engage the interior wall 322 of the housing 282, such that the void 332 can be sealed from the remainder of the cavity 284 for pressurization. In most instances, if the void 332 is not sealed from the remainder of the cavity 284, the pyrotechnic actuator 260 will not function property as the pressure differential between the void 332 and the remainder of the cavity 284 may not be sufficient to deploy the piston 280 and/or the piston assembly 302 by breaking the frangible member 314.

Figure 10:
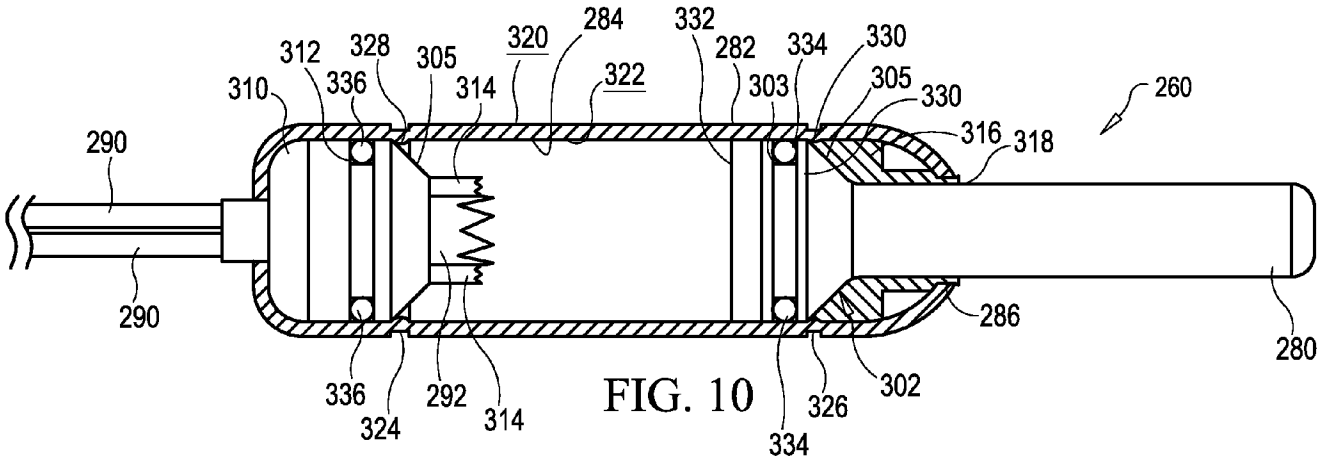
FIG. 10 is a side view of the pyrotechnic actuator of FIG. 9 in the deployed position in accordance with one non-limiting embodiment.
Figure 11:
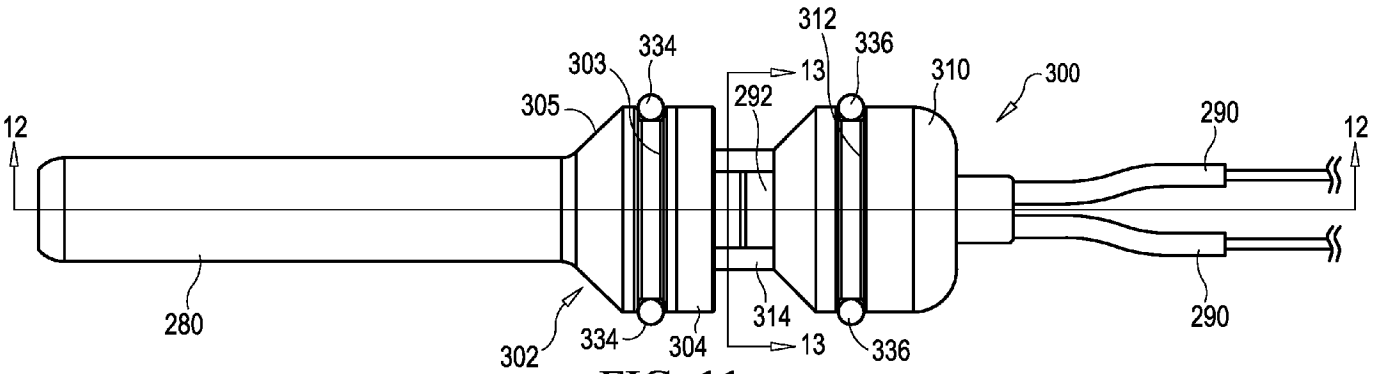
FIG. 11 is a side view of a unibody assembly configured to be positioned at least partially within a housing of a pyrotechnic actuator in accordance with one non-limiting embodiment.

In one embodiment, referring to FIGS. 9-11, the annular groove 303 in the piston 280, the piston engagement member 304, and/or the piston assembly 302 and the annular groove 312 in the base 310 can each be configured to receive a sealing member, such as an o-ring, for example. Such annular grooves 303 and 312 can be omitted, in various embodiments, if sealing members are not provided. A first sealing member 334 can be positioned in the annular groove 303 and a second sealing member 336 can be positioned in the annular groove 312. In one embodiment, the first sealing member 334 and the second sealing member 336 can be adhesively fixed and/or positioned at least partially within their respective annular grooves 303 and 312. The first sealing member 334, when positioned at least partially within the annular groove 303, can be compressed by the interior wall 322 of the housing 282 to create a seal between the piston 280, the piston engagement member 304, and/or the piston assembly 302 and the interior wall 322. The second sealing member 336, when positioned at least partially within the annular groove 312, can be compressed by the interior wall 322 of the housing 282 to create a seal between the body 310 and the interior wall 322. Such seals can create the sealed void 332. As discussed above, the sealed void 332 can house pressurized gas generated by the initiator 292 until such time as the at least one frangible member 314 breaks, thereby moving the piston assembly 302 into the deployed position.

In one embodiment, when the detection system 30 detects a dangerous condition proximate to the blade 14 or detects a foreign object in contact with or proximate to the blade 14, the safety reaction system 32 can be activated by the current pulse. The current pulse can be conducted through the conductors 296, the mating connector 294, the connector interface 288, the conductors 290, the ferrite filter 291 in the conductors 290, to the initiator 292 to cause the initiator 292 to activate, causing a pyrotechnic explosion. The pyrotechnic explosion generates pressurized gas in the void 332 that eventually causes the frangible members 314 to break owing to the pressure within the void 332 and owing to the force that the pressure creates on the piston engagement member 304 and/or the piston assembly 302. The base 310 is fixed within the housing 282 by the lip or projection 328 and, as a result, to release the pressure within the void 332, the piston assembly 302 and/or the piston engagement member 304 moves away from the base 310. Once the frangible members are broken, the piston assembly 302 and/or the piston engagement member 304 is forced away longitudinally from the body 310 and into the deployed position. In the deployed position, the piston 280 contacts the hammer 183 to cause the safety reaction system 32 to drop or fire the blade 14 below the working surface 15 to prevent, or at least inhibit, contact of the foreign object with the blade 14. In one embodiment, the pyrotechnic actuator 260 can actuate in less than five (5) milliseconds, for example. Of course, other actuation times are within the scope of the present disclosure based on the particular application of a pyrotechnic actuator.

In one embodiment, a power cutting tool, such as the table saw 10, for example, can comprise a working surface 15 comprising a throat plate 13 defining an opening therein. The power cutting tool can comprise the blade 14 which is configured to extend into the opening, the detection system 30 for detecting a dangerous condition relative to the blade 14, and the safety reaction system 32 in communication with the detection system 30. The safety reaction system 32 can be configured to cause the blade 14 to quickly move below the working surface 15 when the safety reaction system 32 is activated by the detection system 30. The safety reaction system 32 can comprise the pyrotechnic actuator 260 comprising the housing 282, the piston 280 positioned at least partially within the housing 282, and an insert-molded unitary assembly 300 positioned at least partially within the housing 282. The unitary assembly 300 can comprise the piston engagement member 304 and the base 310. The void 332 can be defined intermediate the piston engagement member 304 and the base 310. The unitary assembly 300 can comprise the at least one frangible member 314 extending intermediate the piston engagement member 304 and the base 310 and the pyrotechnic initiator 292 positioned at least partially within or on the base 310. The pyrotechnic initiator 292, upon application of a current pulse thereto, can be configured to generate a pressurized gas in the void 332 that exerts a force on the piston engagement member 304 to break the frangible member 304, thereby causing the piston engagement member 304 and the piston 280 to move relative to the base 310 and/or the housing 282.

Figure 15:
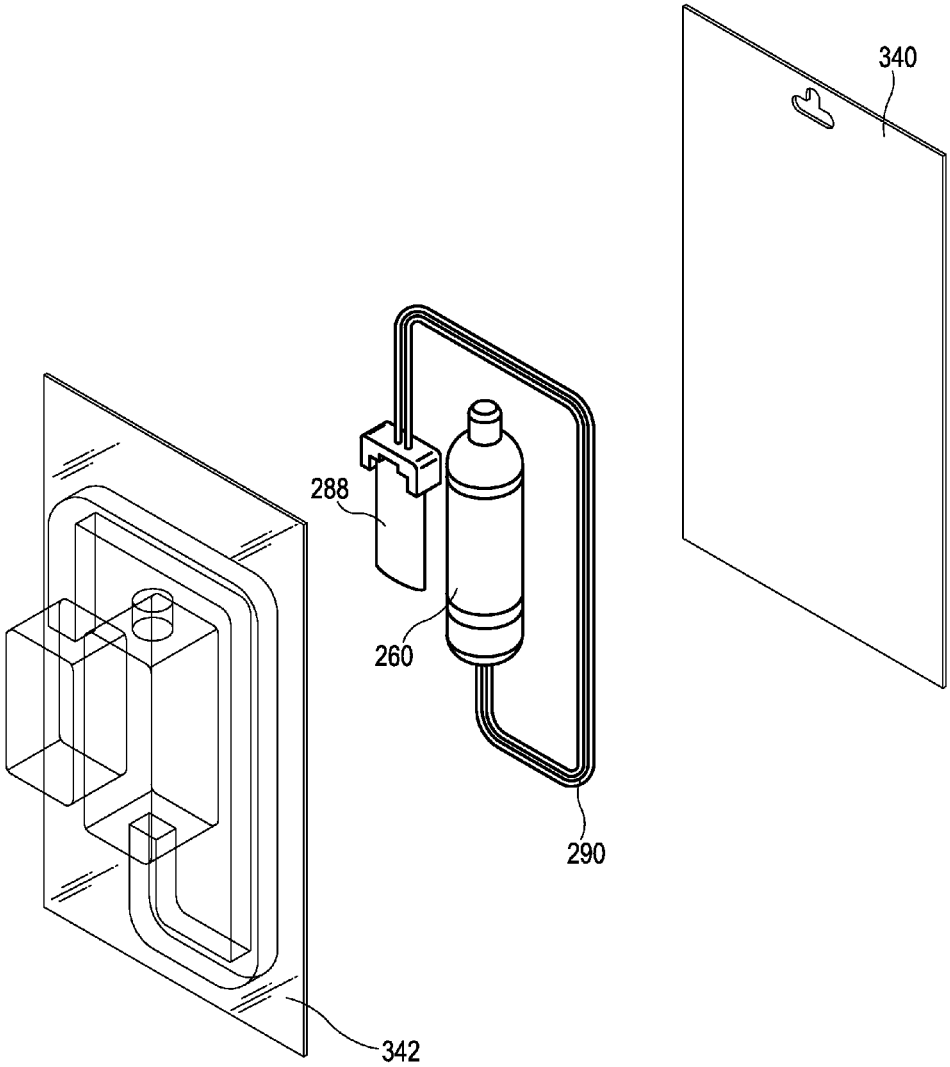
FIG. 15 is a view of a pyrotechnic actuator assembly being packaged in accordance with one non-limiting embodiment.
Figure 16:
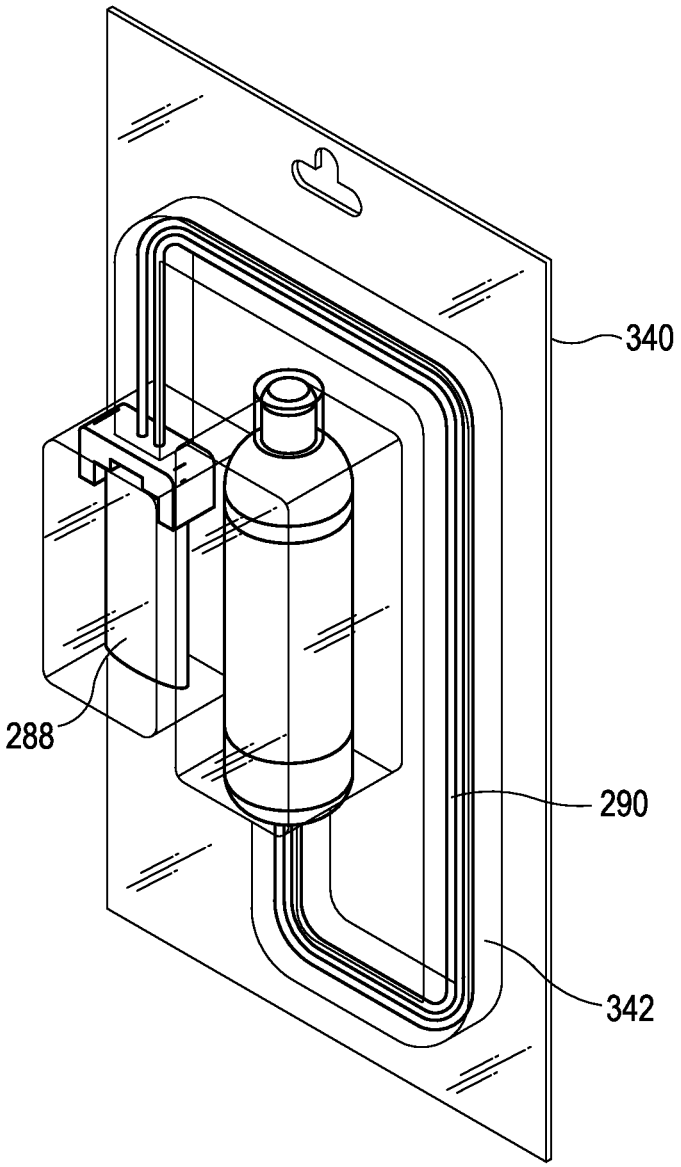
FIG. 16 is a view of the pyrotechnic actuator assembly of FIG. 15 packaged in accordance with one non-limiting embodiment.

In one embodiment, a pyrotechnic actuator assembly of the present disclosure can be easily replaced after it is actuated. The pyrotechnic actuator assembly can comprise the pyrotechnic actuator 260, the connector interface 288, and the conductors 290. By merely separating the connector interface 288 from the mating connector 294 and removing the pyrotechnic actuator assembly from the safety reaction system 32, the pyrotechnic actuator assembly can be replaced with another pyrotechnic actuator assembly comprising the same or similar components. In one embodiment, referring to FIGS. 15 and 16, example packaging 338 for the pyrotechnic actuator assembly is disclosed. FIG. 15 illustrates an exploded view of the packaging 338 and the pyrotechnic actuator assembly, while FIG. 16 illustrates a perspective view of the pyrotechnic actuator assembly within the packaging 338. In various embodiments, the packaging 338 can comprise a backsheet 340 and a cover sheet 342. The backsheet 340 can be comprised of cardboard, other paper-like material, and/or plastic. In one embodiment, the cover sheet 342 can be transparent and can be comprised of plastic or similar material. To assemble the packaging 338, the pyrotechnic actuator assembly can inserted into recesses within the cover sheet 342 and then the cover sheet 342 can be attached to the backsheet 340 using conventional packaging techniques.

Although the pyrotechnic actuators of the present disclosure have been described for use with a power cutting tool, use of such pyrotechnic actuators is not so limited. In fact, many suitable uses exist for the pyrotechnic actuators of the present disclosure. Some example uses include automotive safety restraint systems, defense and aerospace rocket controlled guidance systems, cable cutters, deep hole drilling and mining applications, and fire suppression systems.

Various embodiments are also directed to a method of making the pyrotechnic actuator 260. First, the unibody assembly 300 can be insert-injection molded using a polymer, such as high impact nylon, for example. Other materials that can be used for similar applications include polycarbonate and polyphthalamide. As an alternative to injection molding, reaction injection molding (RIM) can also be used with suitable thermosetting polymers. Also, in various embodiments, die casting processes and powder metal formation processes can be used to form portions of the pyrotechnic initiators of the present disclosure. The unibody assembly 300 can then be installed into the housing 282, with or without the first and second sealing members 334 and 336, depending on the intended application of that particular pyrotechnic actuator. The housing 282 can be pre-formed on the end that receives the base 310. A bushing 316 can be installed in the end of the housing 282 that defines the opening 284. The end of the housing 282 that defines the opening 284 can then be formed to enclose the unibody assembly 300. The at least one annular groove 303 or 312 can then be formed on the exterior wall 320 of the housing 282 to form the lips or projections 328 or 330.

All documents cited in the Detailed Description are, in relevant part, incorporated herein by reference in their entirety. The citation of any document is not to be construed as an admission that it is prior art with respect to the present disclosure. To the extent that any meaning or definition of a term in the present disclosure conflicts with any meaning or definition of the term in a document incorporated by reference, the meaning or definition assigned to the term in the present disclosure shall govern.

While particular non-limiting embodiments of the present disclosure have been illustrated and described, those of skill in the art will recognize that various other changes and modifications can be made without departing from the spirit and scope of the present disclosure. It is therefore intended to cover in the appended claims all such changes and modifications that are within the scope of the present disclosure.

What is claimed is:

1. A pyrotechnic actuator for a power cutting tool, the pyrotechnic actuator comprising:
- a housing defining a cavity therein;
- a piston positioned at least partially within the cavity; and
- an insert-molded unitary assembly positioned within the cavity, the unitary assembly comprising:
  - a piston engagement member;
  - a base, wherein a sealed void is defined intermediate the piston engagement member and the base;
  - a breakable member extending intermediate the piston engagement member and the base; and
  - a pyrotechnic initiator positioned at least partially within the base, wherein the pyrotechnic initiator, upon application of a current pulse thereto, is configured to generate a pressurized gas in the sealed void that exerts a force on the piston engagement member and breaks the breakable member thereby causing the piston engagement member and the piston to move relative to the base and the housing.

2. The pyrotechnic actuator of claim 1, wherein the piston engagement member comprises an annular groove defined in a face thereof, wherein the piston comprises an annular projection extending from an end thereof and wherein the annular projection is configured to be engaged with the annular groove to engage the piston with the piston engagement member.

3. The pyrotechnic actuator of claim 1, wherein the housing comprises an interior wall comprising a lip extending inwardly toward the unitary assembly.

4. The pyrotechnic actuator of claim 3, wherein the lip engages the base prior to and after actuation of the pyrotechnic initiator.

5. The pyrotechnic actuator of claim 3, wherein the lip engages the piston assembly after actuation of the pyrotechnic initiator.

6. The pyrotechnic actuator of claim 1, wherein the breakable member comprises a plurality of frangible struts.

7. A pyrotechnic actuator, comprising:
- a housing defining a cavity therein, the housing defining an opening therethrough; and
- a unibody assembly positioned at least partially within the cavity, the unibody assembly comprising:
  - a piston assembly, wherein a portion of the piston assembly is configured to extend through the opening;
  - a base, wherein a void is defined intermediate the piston assembly and the base;

a frangible member extending intermediate the piston assembly and the base; and a pyrotechnic initiator, wherein the base is configured to receive at least a portion of the pyrotechnic initiator, and wherein the pyrotechnic initiator, upon application of a current pulse thereto, is configured to generate a pressurized gas in the void that exerts a force on the piston assembly and breaks the frangible member thereby causing the piston assembly to move relative to the base and the housing.

8. The pyrotechnic actuator of claim 7, comprising a first sealing member and a second sealing member, wherein the base comprises a first annular groove, wherein the piston assembly comprises a second annular groove, wherein the first annular groove is configured to at least partially receive the first sealing member, and wherein the second annular groove is configured to at least partially receive the second sealing member.

9. The pyrotechnic actuator of claim 8, wherein the first and second sealing members are configured to create an air-tight seal in the void.

10. The pyrotechnic actuator of claim 7, wherein the frangible member comprises a plurality of frangible struts.

11. The pyrotechnic actuator of claim 7, wherein the piston assembly comprises:

a piston engagement member; and a piston;

wherein the piston assembly is in a first position relative to the base prior to ignition of the pyrotechnic initiator, and wherein the piston assembly is in a second position relative to the pyrotechnic actuator after ignition of the pyrotechnic initiator.

12. The pyrotechnic actuator of claim 7 wherein the piston assembly comprises:

a piston engagement member; and a piston.

13. The pyrotechnic actuator of claim 12, wherein the base, the frangible member, and the piston engagement member are comprised non-metallic materials, and wherein the piston is comprised of a metallic material.

14. The pyrotechnic actuator of claim 12, wherein the piston extends from the housing a first distance prior to actuation of the pyrotechnic initiator, and wherein the piston extends from the housing a second distance after actuation of the pyrotechnic initiator.

15. The pyrotechnic actuator of claim 7 wherein the housing comprises an interior wall comprising a projection extending inwardly toward the unibody assembly.

16. The pyrotechnic actuator of claim 15, wherein the projection engages the base prior to and after actuation of the pyrotechnic initiator.

17. The pyrotechnic actuator of claim 15, wherein the projection engages the piston assembly after actuation of the pyrotechnic initiator.

18. The pyrotechnic actuator of claim 7 wherein the housing comprises an exterior wall, and wherein the exterior wall comprises at least one annular groove therein.

19. The pyrotechnic actuator of claim 7 comprising a bushing configured to receive a portion of the piston assembly therethrough, wherein the bushing is positioned proximate to the opening.

20. A power cutting tool, comprising:

a working surface defining an opening therein;

a blade configured to extend into the opening;

a detection system for detecting a dangerous condition relative to the blade; and a safety reaction system in communication with the detection system, wherein the safety reaction system is configured to cause the blade to move below the working surface when triggered by the detection system, the safety reaction system comprising:

a pyrotechnic actuator, comprising:

a housing;

a piston positioned at least partially within the housing; and an insert-molded unitary assembly positioned at least partially within the housing, the unitary assembly comprising:

a piston engagement member;

a base, wherein a void is defined intermediate the piston engagement member and the base;

a frangible member extending intermediate the piston engagement member and the base; and a pyrotechnic initiator positioned on the base, wherein the pyrotechnic initiator, upon application of a current pulse thereto, is configured to generate a pressurized gas in the void that exerts a force on the piston engagement member and breaks the frangible member thereby causing the piston engagement member and the piston to move relative to at least one of the base and the housing.

* * * * *